United States Patent [19]

Imai

[11] Patent Number: 4,910,557

[45] Date of Patent: Mar. 20, 1990

[54] IMAGE DENSITY CONTROL METHOD FOR AN IMAGE FORMING APPARATUS

[75] Inventor: Chikara Imai, Tokyo, Japan

[73] Assignee: Ricoh Company, Ltd., Tokyo, Japan

[21] Appl. No.: 317,563

[22] Filed: Mar. 1, 1989

[30] Foreign Application Priority Data

Mar. 1, 1988 [JP] Japan ..... 63-48221

[51] Int. Cl.[4] ..... G03G 15/08

[52] U.S. Cl. ..... 355/246; 355/203; 355/208; 355/261

[58] Field of Search ..... 355/246, 261, 203, 208, 355/204; 118/653, 691

[56] References Cited

U.S. PATENT DOCUMENTS

| | | | |
|---|---|---|---|
| Re. 32,330 | 1/1987 | Miyakawa et al. | 355/246 X |
| 4,684,239 | 8/1987 | Takayanagi et al. | 355/246 X |
| 4,733,276 | 3/1988 | Kakitani | 355/246 X |
| 4,786,924 | 11/1988 | Folkins | 355/246 X |
| 4,796,065 | 1/1989 | Kanbayashi | 355/246 X |

*Primary Examiner*—A. C. Prescott

*Attorney, Agent, or Firm*—Oblon, Spivak, McClelland, Maier & Neustadt

[57] ABSTRACT

An image density control method for an image forming apparatus controls any of various image forming conditions such as toner density on the basis of a result of image density detection which is executed in a pattern detection mode. A plurality of pattern detection modes are provided each for developing the latent image of a pattern having a reference voltage under a different potential for development. A development gamma characteristic representative of a characteristic relationship between the amount of toner deposited on the resulting toner image representative of the pattern and the potential for development on the basis of the results of detection which are individually associated with the plurality of pattern detection modes. The image forming condition is controlled such that the determined development gamma characteristic substantially coincides with a target development gamma characteristic.

2 Claims, 3 Drawing Sheets

IMAGE DENSITY CONTROL METHOD FOR AN IMAGE FORMING APPARATUS

BACKGROUND OF THE INVENTION

The present invention relates to an image density control method for an image forming apparatus and, more particularly, to an image density control method for an image forming apparatus which controls various image forming conditions such as toner density on the basis of a result of image density detection which is executed in a pattern detection mode.

Generally, an electrophotographic copier, facsimile machine, laser printer or similar image forming apparatus uniformly charges the surface of an image carrier in the form of a photoconductive element by a charger, then exposes the charged surface to imagewise light representative of an image to be recorded to thereby form an electrostatic latent image on the charged surface, develops the latent image by using a developer which is stored in a developing unit, and transfers the resulting toner image to a paper sheet. The density and other conditions associated with the toner image are dictated by various image forming conditions such as the density or content of toner which is contained in the developer. The image forming conditions such as toner density in the developing unit have customarily been controlled by sensing the density of the toner image in terms of reflectance or similar factor, and comparing the sensed image density with a reference value. By so controlling the image forming conditions, it is possible to maintain the density and other conditions associated with the toner image constant.

The detection of image density is extensively implemented by an optical detection system. The optical detection system is operable in a pattern detection mode in which the uniformly charged surface of the photoconductive element is exposed to an imagewise reflection from a reference pattern which has predetermined reflectance, the resulting latent image is developed by the toner to produce a toner image, and the density of the toner image is sensed and compared with a reference density. The control of image density or similar image forming condition which adopts such a pattern detection mode maintains the toner density in the developer constant by detecting a change in image density caused by a change in developing ability which is ascribable to the deterioration of the developer and the varying ambient conditions, a change in charge potential which is ascribable to the deterioration of the photoconductive element or that of the wire of the charger or the variation of a source voltage, and a change in the quantity of light for imagewise exposure. This kind of control is therefore quite effective to maintain the density of developed images constant. Typical of the image forming conditions to be controlled are the toner density mentioned above, amount of charged deposited on the toner, bias voltage for development, characteristics of the developer, gap for development, developing speed (developing time), amount of charge deposited on the photoconductive element, characteristics of the photoconductive element, amount of imagewise exposure, and sensing characteristics.

A problem with the image density detection which relies on the pattern detection mode is that when the charge or the quantity of light is irregularly distributed in a surface portion of the photoconductive element which corresponds to a reflection from the reference pattern, the image forming conditions such as toner density are apt to be overcorrected. For example, assume that the charge potential deposited on the photoconductive element is lower in the above-mentioned particular surface portion than in the other portion due to local contamination of the charger wire. Then, the sensed image density will be lower than the actual image density. In this condition, supplying the toner based on the result of detection would cause the toner density to become higher than an ordinary density and, in the worst case, smear the interior of the machine. Further, it sometimes occurs that the potential on the surface of the photoconductive element is varied over the entire surface and not in a part thereof due to the deterioration and fatigue of the element itself and the varying ambient conditions, also resulting in the above-discussed problem.

In the light of this, there has been proposed an image density control method which measures and controls a developing characteristic only, as disclosed in Japanese Patent Application No. 56-159637. The method disclosed in this Patent Application consists in providing on a photoconductive element a charged portion which is close to zero volt, or saturation potential, developing this portion under a bias potential which is opposite to a predetermined bias voltage adapted for ordinary image forming operations, sensing the density of the resulting toner image, and comparing the sensed density with a predetermined value. This kind of approach causes a toner to adhere to a photoconductive element by using a potential close to the saturation level at which the surface potential of the element is most stable. Hence, it is not necessary to take account of a change in image density due to changes in image forming conditions other than the developing ability of the developer itself, i.e., charging characteristic, developing characteristic and the like, whereby rapid and accurate image density control is achievable. However, this prior art approach has a drawback that in the image density detection mode the bias voltage for development has to be switched over to the opposite side to the bias vltage for ordinary image forming operations. Another drawback is that a complicated power supply circuit is needed.

Another approach is disclosed in Japanese Laid-Open Patent Publication (Kokai) No. 48-29488. In this Laid-Open Patent Publication, an electrode is wound around a part of a photoconductive element so that the surface of the element where the electrode is located may be held at a predetermined potential. This, however, brings about another shortcoming that the electrode itself and the arrangement for mounting it on a photoconductive element are complicated.

Although U.S. Pat. No. 4,632,537 (Imai) and U.S. Pat. No. 4,619,522 (Imai) also teach techniques relating to the image control method of the present invention, they are entirely different from the method of the present invention.

SUMMARY OF THE INVENTION

It is therefore an object of the present invention to provide an image density control method for an image forming apparatus which performs image density detection in a pattern detection mode accurately by eliminating the influence of the change in the surface potential of a photoconductive element and controls various image forming conditions based on the result of detection.

It is another object of the present invention to provide a generally improved image density control method for an image forming apparatus.

In accordance with the present invention, in an image density control method for an image forming apparatus which executes detection in a pattern detection mode in which an electrostatic latent image formed on an image carrier to have a predetermined potential and representative of a pattern having a reference density is developed under a predetermined potential for development defined by a bias voltage which is applied to a developing station so as to produce a toner image associated with the pattern, and an amount of toner deposited on the toner image is sensed and compared with a reference value, the method performing control of an image condition to set up any of various image forming conditions in response to a result of the detection, a plurality of pattern detection modes are provided each for developing the latent image of the pattern having a reference voltage under a different potential for development. A development gamma characteristic representative of a characteristic relationship between the amount of toner deposited on the toner image and the potential for development is determined on the basis of the results of detection which are individually associated with the plurality of pattern detection modes. The image forming condition is controlled such that the determined development gamma characteristic substantially coincides with a target development gamma characteristic.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
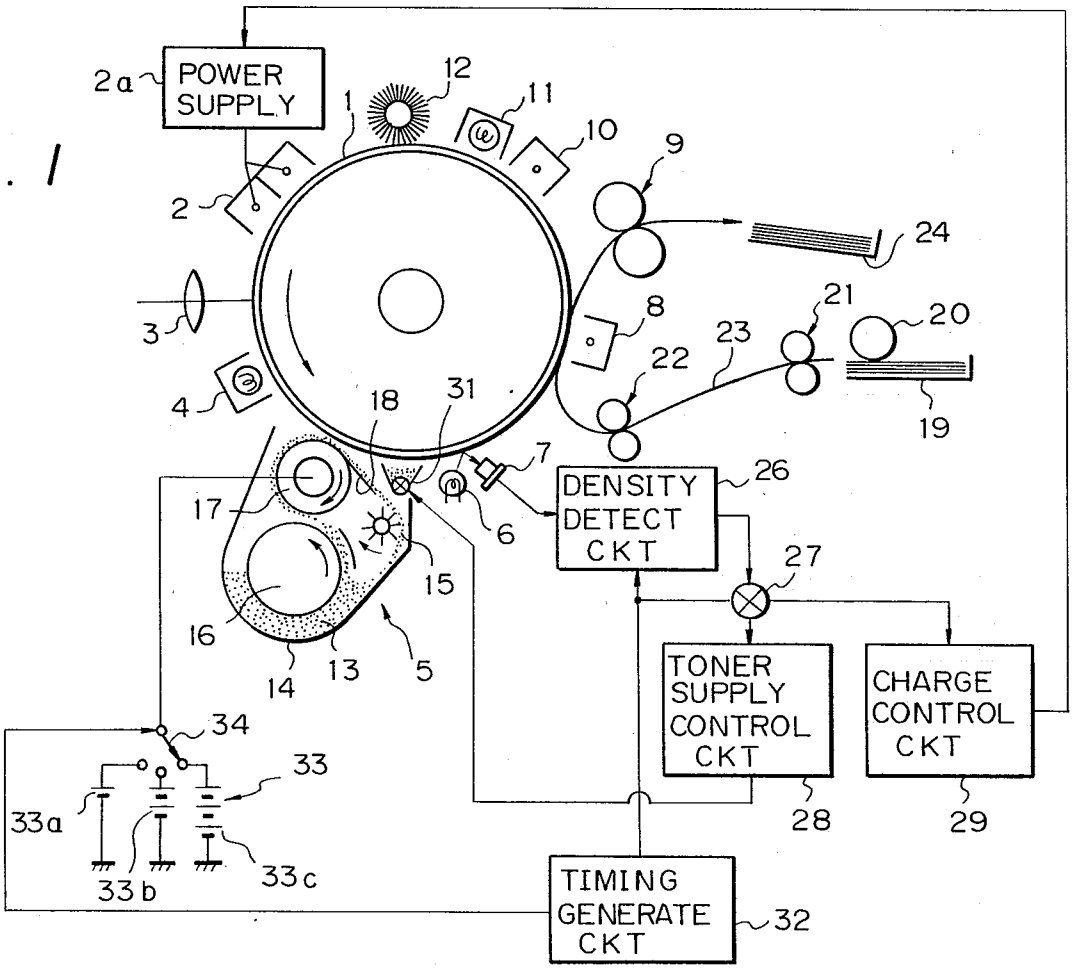
FIG. 1 is a schematic view of an image recorder in the form of an electrophotographic copier to which the present invention is applied.

Referring to FIG. 1 of the drawings, an image forming apparatus to which the present invention is applied is shown and implemented as an electrophotographic copier by way of example. As shown, the copier includes an image carrier in the form of a photoconductive drum 1 which is rotatable counterclockwise as viewed in the drawing. Arranged around the drum 1 are a main charger 2, optics 3 for imagewise exposure, an erase lamp 4, a developing unit 5, a light emitting element 6 and a light-sensitive element 7 which cooperate to sense an amount of toner deposited on a toner image, a transfer charger 8, a fixing unit 9, a discharger 10, a discharge lamp 11, and a cleaning unit 12. A high-tension power supply 2*a* is associated with the main charger 2. The main charger 2 uniformly charges the surface of the drum 1 to a voltage of predetermined polarity, e.g. +800 volts. An imagewise reflection representative of a document is propagated through the optics 3 to be focused on the charged surface of the drum 1, whereby the charge on the drum 1 is selectively erased to form an electrostatic latent image. The developing unit 5 supplies a toner to the latent image on the drum 1 to produce a toner image. The drum 1 has a conductive layer with or without a dielectric layer deposited on the conductive layer.

The developing unit 5 includes a reservoir 14 for storing a two-component developer 13 which is the mixture of a toner and a magnetic carrier. While the developer is agitated by a bladed wheel 15 and scooped up by a roller 16, the toner is charged to the polarity opposite to the polarity of the latent image due to its friction with the carrier. After such a toner and carrier mixture has been transferred from the roller 16 to a developing roller 17, it is transported to a developing station adjacent to the drum 1 so that only the toner is deposited on the latent image to develop the latter. After the image development, the developer remaining on the developing roller 17 is removed from the roller 17 by a scraper 18. In an ordinary copy mode operation, the resulting toner image on the drum 1 is laid on a paper sheet 23 which is fed from a paper cassette 19 by a feed roller 20 and transport roller pairs 21 and 22. Then, the transfer charger 8 is energized to charge the toner image to the opposite polarity to the polarity of the toner, thereby transferring the toner image to the paper sheet 23. The paper sheet 23 to which the toner image has been transferred is separated from the drum 1, then transported to the fixing unit 9 for fixing the toner image, and then driven out of the copier onto a tray 24. After such image transfer, the discharger 10 and discharge lamp 11 are energized to dissipate the charge remaining on the drum 1. Thereafter, the cleaning unit 12 removes the toner remaining on the drum 1.

The light emitting element 6 and the light-sensitive element 7 may be implemented as a light emitting diode and a photodiode, respectively. The quantity of light issuing from the light emitting element 6 and being reflected by the surface of the drum 1 varies with the amount of toner deposited on the drum 1, causing an output of the light-sensitive element 7 to change. An output signal of the light-sensitive element 7 is applied to a density detecting circuit 26. The density detecting circuit 26 compares the output of the light-sensitive element 7 with a reference voltage which is representative of a reference amount of toner deposition. An output of the density detecting circuit 26 representative of the result of comparison is routed through a switch 27 to a toner supply control circuit 28 and a charge control circuit 29. When the actual amount of toner deposited on the drum 1 is smaller than the reference amount as determined by the circuit 26, the toner supply control circuit 28 feeds a toner supply signal associated with the decrement to a toner supply device 31 which is associated with the developing unit 5. A toner supply roller is accommodated in the toner supply device 31 for supplying to the reservoir 14 a particular amount of toner as commanded by the toner supply signal from the toner supply control circuit 28. The charge control circuit 29 compares the actual amount of toner deposition with a reference amount and delivers a current control signal to the high-tension power supply 2*a* of the main charger 2 based on the result of comparison.

A timing generating circuit 32 applies a switching signal to the density detecting circuit 26 to turn the latter from an OFF state to an ON state. The switching signal is also fed to a switch 34 associated witha power supply circuit 33 which applies a bias voltage for development to the developing roller 17. The switch 34 selects three independent power supplies 33*a*, 33*b* and 33*b* included in the power supply circuit 33, one at a time. Among the power supplies 33*a* to 33*c*, the power supply 33*a* is adapted for ordinary image forming operations and has a standard output of +300 volts, although the standard output is variable to the user's taste. The other two power supplies 33*b* and 33*c* are exclusively assigned to density detection and have outputs of +500 volts and +600 volts, respectively.

Figure 2:
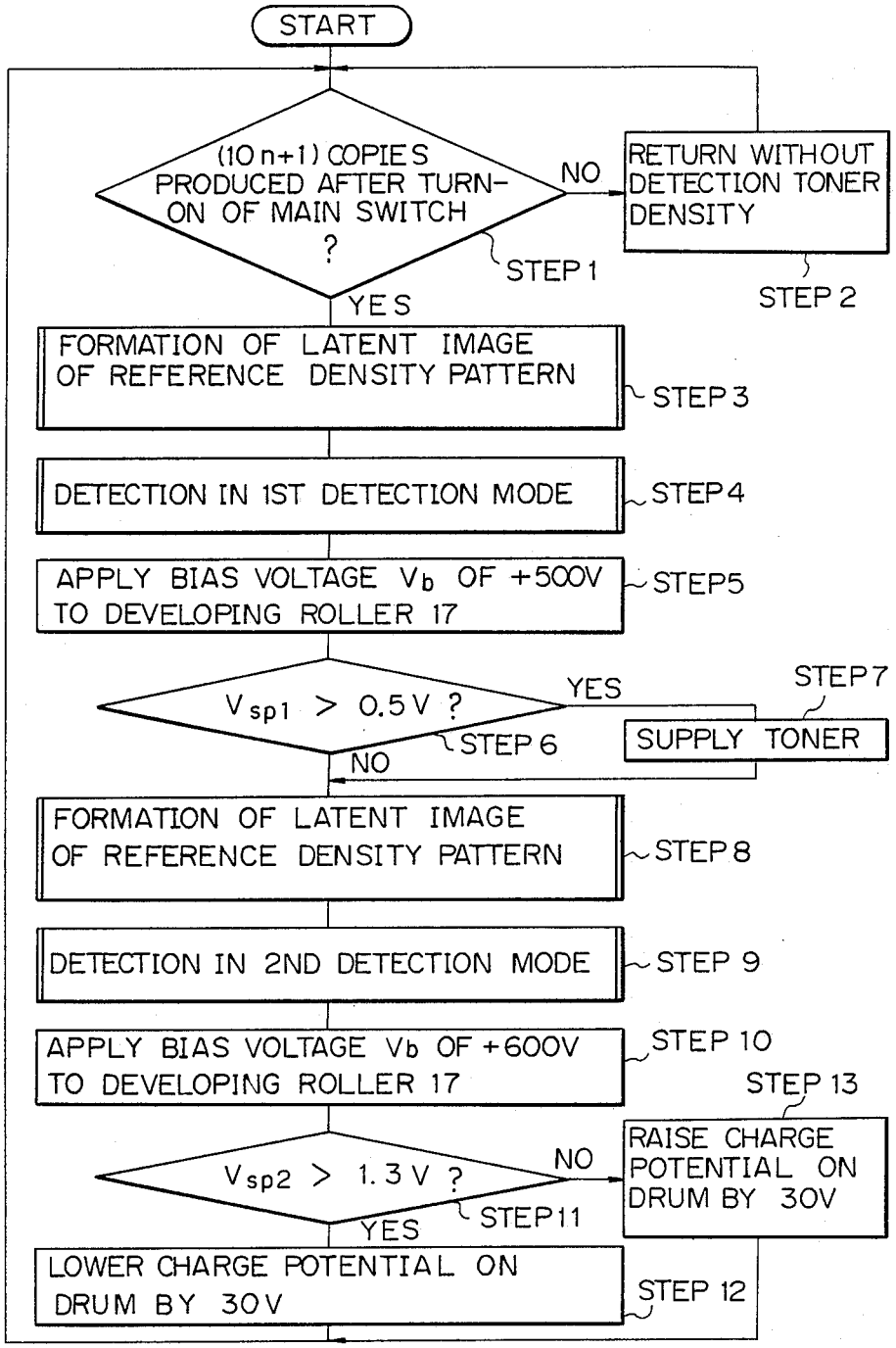
FIG. 2 is a flowchart demonstrating an image control procedure in accordance with the present invention.

Referring to FIG. 2, a sequence of steps for image density control in accordance with the present invention which is applied to the above-described copier is shown. Upon the start of a density detecting operation, i.e., a control in a pattern detection mode, the program determines whether or not a detection timing in the pattern detection mode has been reached (STEP 1). More specifically, since the detection in the pattern detection mode is effected for every ten copies, the program sees if "10n+1" copies have been produced after the turn-on of a main switch of the copier. If the answer of the STEP 1 is NO, a STEP 2 is executed not to perform the detection and the program returns. If the answer of the STEP 1 is YES, a STEP 3 and successive steps are sequentially executed to perform the detection in the pattern detection mode twice.

The first detection in the pattern detection mode begins with a STEP 3 for forming a latent image of a reference density pattern on the drum 1 by a potential of +750 volts. In the subsequent STEP 4, detection in a first pattern detection mode begins. For this detection, the switch 34 associated with the power supply circuit 33 is brought into connection with the power source 33*b*, whereby a bias voltage Vb of +500 volts is applied to the developing roller 17 (STEP 5). As a result, a potential of 250 volts (=750−500) is set up in the developing station. A latent image of the reference density pattern is developed under such a potential to be thereby turned into a toner image. Light issuing from the light emitting element 6 is reflected by the resulting first pattern toner image and then received by the light-sensitive element 7. The quantity of reflection from the toner image and therefore the output of the light-sensitive element 7 varies with the amount of toner deposition on the first pattern toner image. An output signal Vsp1 of the light-sensitive element 7 is applied to the density detecting circuit 26. The density detecting circuit 26 compares the signal Vsp1 with a reference voltage of 0.5 volt which is representative of a reference amount of toner deposition, as presented by a STEP 6 in the figure. An output signal of the circuit 26 representative of the result of comparison is routed through the switch 27 to the toner supply control circuit 28. When the actual amount of toner deposited on the drum 1 is smaller than the reference amount, the toner supply control circuit 28 feeds a toner supply signal associated with the decrement to the toner supply device 31 which is associated with the developing unit 5. The toner supply roller accommodated in the toner suply device 31 supplies to the reservoir 14 a particular amount of toner as commanded by the toner supply signal from the toner supply control circuit 28.

The first detection in the pattern detection mode is followed by the second detection in the same mode. First, in a STEP 8, a latent image of the reference density pattern is formed on the drum 1 by a potential of +750 volts. In the subsequent STEP 9, detection in a second pattern detection mode begins. For this detection, the switch 34 associated with the power supply circuit 33 is brought into connection with the power source 33*c*, whereby a bias voltage Vb of +600 volts is applied to the developing roller 17 (STEP 5). As a result, a potential of 150 volts (=750−600) is set up in the developing station. A latent image of the reference density pattern is developed under such a potential to be thereby turned into a toner image. Light issuing from the light emitting element 6 is reflected by the resulting second pattern toner image and then received by the light-sensitive element 7. The quantity of reflection from the toner image and therefore the output of the light-sensitive element 7 varies with the amount of toner deposition on the first pattern toner image. An output signal Vsp2 of the light-sensitive element 7 is applied to the density detecting circuit 26. The density detecting circuit 26 compares the signal Vsp2 with a reference voltage of 1.3 volts which is representative of a reference amount of toner deposition, as represented by a STEP 11 in the figure. An output signal of the circuit 26 representative of the result of comparison is routed through the switch 27 to the charge control circuit 29. In response, the charge control circuit 29 delivers a current control signal to the high-tension power supply 2*a* of the main charger 2 on the basis of the relationship between the actual and reference amounts of toner deposition. When the actual amount of toner deposition on the second pattern toner image is greater than the reference amount, a STEP 12 is executed for lowering the charging current of the main charger 2 such that the charge potential Vs on the drum 1 is reduced by 30 volts. Alternatively, an arrangement may be made to reduce the grid voltage of the charger 2 instead of the charging current. When the amount of toner deposition on the second pattern toner image is smaller than the reference amount, a STEP 13 is executed for increasing the charging current or the grid current of the main charger 2 such that the charge potential Vs on the drum 1 is increased by 30 volts. The specific voltage of 30 volts is successful in achieving the effect particular to the potential change without affecting the image quality abruptly. This voltage, however, does not have to be strictly 30 volts because the influence and effect thereof will be checked by the next detection in the pattern detection mode.

By controlling the charge potential on the drum 1 with such a plurality of pattern detection modes, a development gamma characteristic representative of a relationship between the amount of toner deposition on a pattern toner image and the potential for development is obtained as will be described with reference to FIG. 3. The charge potential condition, or image-forming condition, on the drum 1 is controlled such that the obtained development gamma characteristic substantially agrees with a target gamma characteristic.

Figure 3:
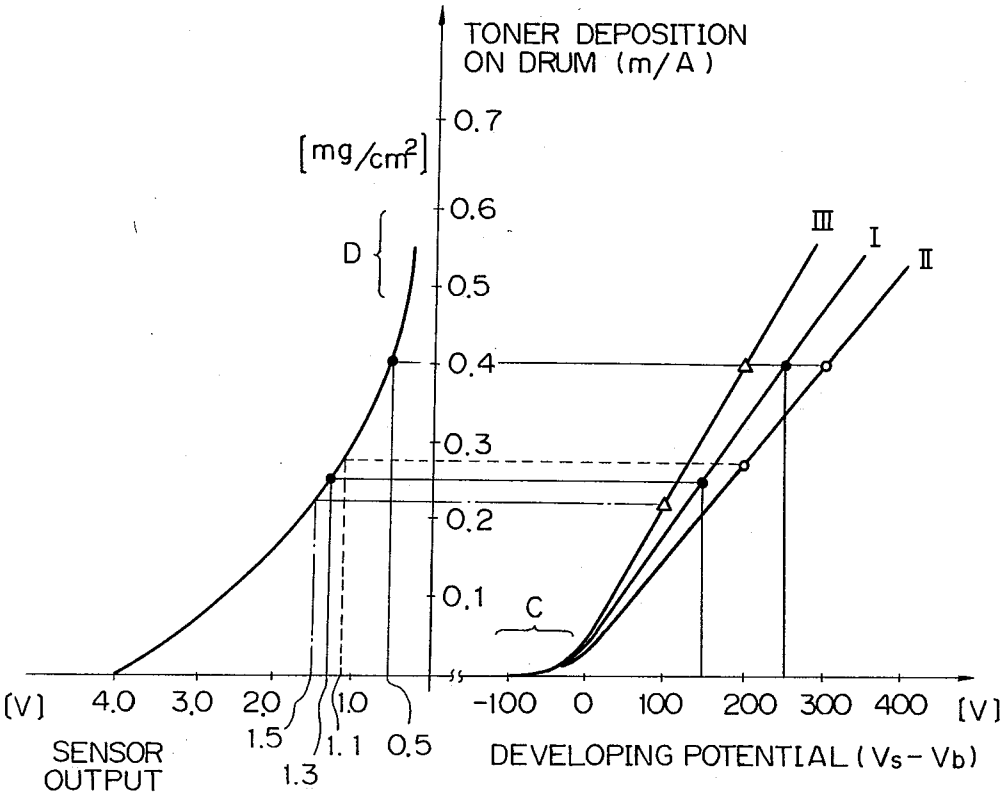
FIG. 3 is a plot showing a development gamma characteristic and an amount of toner deposition associated therewith.

In FIG. 3, the amount of toner deposition m/A (ordinate) on a pattern toner image is shown on the right-hand side with respect to the potential for development (abscissa) while the sensor output (ordinate) is shown in the left-hand side with respect to the amount of toner deposition m/A. A gamma characteristic curve I shown in the right part of FIG. 3 is representative of a target development characteristic to be maintained and is selected on the assumption that various image-forming conditions such as the charge on the drum 1, velocity of the developing roller 17, developing gap and reference toner density have their predetermined values. So long as the actual gamma characteristic substantially agrees with the target gamma characteristic, 0.4 mg/cm$^2$ of toner is deposited on the pattern toner image for the developing potential of 250 volts (750−500) which is assigned to the first pattern detection mode. In this condition, the sensor output is 0.5 volt. The potential of 250 volts mentioned above is used as a reference. For the potential of 150 volts (750−600) assigned to the second pattern detection mode, 0.25 mg/cm$^2$ of toner is deposited on the pattern toner image and the sensor output is 1.3 volts. In such a normal situation, i.e., when the drum 1 is free from fatigue and deterioration and has its charge potential protected against the variations of ambient conditions and the various image-forming conditions including the roller velocity, developing gap and reference toner density have their predetermined values, a toner which is sequentially consumed by repeated development is supplied in such a manner as to maintain the sensor output of 0.5 volt. This insures accurate image density control.

Assume that the charge potential on the drum 1 is varied due to the fatigue or deterioration of the drum 1 or the changes in ambient conditions or the deviation of any of the image-forming conditions from the predetermined value. Then, the gamma characteristic is also deviated from the target characteristic. For example, when the potential Vs on the drum 1 is increased by 50 volts to 800 volts, the gamma characteristic is shifted as represented by a curve II in FIG. 3. With the prior art pattern detection mode, therefore, the operation for supplying a toner is overcorrected as indicated by the curve II.

The illustrative embodiment of the present invention causes the deviated gamma characteristic II to return to the target characteristic I on the basis of the result of detection which is performed in the second pattern detection mode. Specifically, in the gamma characteristic II deviated from the target characteristic I, the sensor output is lowered from the original voltage of 1.3 volts to a voltage of 1.1 volts for the potential of 200 volts (800−600) associated with the second pattern detection mode. Conversely, when the potential Vs on the drum 1 is lowered by 50 volts to 700 volts, the target characteristic I is shifted to a characteristic III also shown in FIG. 3 with the result that the sensor output is increased from 1.3 volts to 1.5 volts for the potential of 100 volts (700−600) associated with the second pattern detection mode. When the sensor output in the second pattern detectiion mode is lower than the expected output Vsp2, the actual gamma characteristic has a smaller gradient than the target characteristic; when the former is higher than the latter, the actual gamma characteristic has a greater gradient than the target characteristic. It is therefore possible to determine the currently controlled gamma characteristic on the basis of the result of the second pattern detection mode.

As the charge on the drum 1, i.e., the charging current or the grid voltage of the main charger 2 is adjusted on the basis of the obtained development gamma characteristic as stated above, the actual gamma characteristic is brought closer to the target gamma characteristic. This eliminates the overcorrection of toner density ascribable to the variation of gamma characteristic, change in the amount of charge deposited on the toner, and scattering of the toner or contamination of background due to such a change in the amount of charge on the toner. The change in charge potential may be effected either during pattern development only or during both of pattern development and image development. Changing the charge potential during both of pattern development and image development is successful in correcting the variation of image quality due to the change in charge potential with the lapse of time also. It is to be noted that the image-forming conditions for correcting the gamma characteristic may include not only the charge on the drum 1 but also the other conditions previously mentioned.

By effecting the control operations on the basis of the development gamma characteristic as stated above, more accurate detection control is promoted and, moreover, a gamma characteristic can be determined even when the image-forming condition or conditions are varied.

While the gamma characteristic discussed above with reference to FIG. 3 is not linear, it is not critical if the method is practiced in the range other than the range labeled C or D. Although the illustrative embodiment changes the charge on the drum 1 by each 30 volts, it may alternatively change the bias voltage for development by each 30 volts. Again, the change of bias voltage may be effected either during pattern development only or during both of pattern development and image development. Further, the sensor output may be normalized by an output representative of zero toner deposition in order to compensate for the contamination of the sensor. It should be born in mind that the embodiment shown and described is applicable not only to a two-component developer but also to a one-component developer.

In summary, it will be seen that the present invention provides an image density control method which allows pattern detection in a pattern detection mode to be executed with accuracy while eliminating the influence of changes in the potential on a photoconductive element and the like, thereby controlling image-forming conditions stably. Further, the method can be practiced without resorting to a special electrode plate or similar extra element and therefore with a simple construction.

Various modifications will become possible for those skilled in the art after receiving the teachings of the present disclosure without departing from the scope thereof.

What is claimed is:

1. An image density control method for an image forming apparatus which executes detection in a pattern detection mode in which an electrostatic latent image formed on an image carrier to have a predetermined potential and representative of a pattern having a reference density is developed under a predetermined potential for development defined by a bias voltage which is applied to a developing station so as to produce a toner image associated with the pattern, and an amount of toner deposited on the toner image is sensed and compared with a reference value, said method performing control of an image condition to set up any of various image forming conditions in response to a result of the detection, said method comprising the steps of:

(a) providing a plurality of pattern detection modes each for developing the latent image of the pattern having a reference voltage under a different potential for development;

(b) determining a development gamma characteristic representative of a characteristic relationship between the amount of toner deposited on the toner image and the potential for development on the basis of the results of detection which are individually associated with the plurality of pattern detection modes; and (c) controlling the image forming condition such that the determined development gamma characteristic substantially coincides with a target development gamma characteristic.

2. A method as claimed in claim 1, wherein the image forming condition comprises a toner density, and the control of an image condition comprises control of an image density.

* * * * *